US007207805B2

(12) United States Patent
Moore et al.

(10) Patent No.: US 7,207,805 B2
(45) Date of Patent: Apr. 24, 2007

(54) ENCAPSULATED TRAY AND END CAPS FOR A WRITING BOARD

(75) Inventors: Greg Moore, Morgans Point, TX (US); John C. Hardt, II, Belton, TX (US)

(73) Assignee: Mooreco, L.P., Temple, TX (US)

( * ) Notice: Subject to any disclaimer, the term of this patent is extended or adjusted under 35 U.S.C. 154(b) by 238 days.

(21) Appl. No.: 10/874,580

(22) Filed: Jun. 24, 2004

(65) Prior Publication Data

US 2005/0014125 A1 Jan. 20, 2005

Related U.S. Application Data

(60) Provisional application No. 60/575,001, filed on May 28, 2004, provisional application No. 60/509,043, filed on Jun. 24, 2003.

(51) Int. Cl.
*B43L 1/00* (2006.01)

(52) U.S. Cl. ..... 434/408

(58) Field of Classification Search ..... 434/408, 434/413, 416, 417, 421, 425
See application file for complete search history.

(56) References Cited

U.S. PATENT DOCUMENTS

| | | | | |
|---|---|---|---|---|
| 80,410 | A | | 7/1868 | Heneage |
| 88,467 | A | | 3/1869 | French |
| 113,678 | A | | 4/1871 | Lugenbell |
| 2,319,278 | A | | 5/1943 | Urbain |
| 2,651,852 | A | | 9/1953 | Urbain |
| 2,881,538 | A | | 4/1959 | Lewis |
| 3,008,249 | A | | 11/1961 | Masters |
| 3,038,571 | A | | 6/1962 | Clements |
| 3,043,023 | A | | 7/1962 | Colpo |
| 3,190,603 | A | | 6/1965 | Finnemann |
| 3,333,912 | A | | 8/1967 | Kunz et al. |
| 3,363,341 | A | | 1/1968 | Glassman |
| 3,363,871 | A | | 1/1968 | Slazik et al. |
| 4,375,881 | A | * | 3/1983 | Mitchell ..... 248/447.1 |
| 4,828,502 | A | * | 5/1989 | Leahy ..... 434/416 |
| 5,035,626 | A | | 7/1991 | Persing |
| 5,081,936 | A | * | 1/1992 | Drieling ..... 108/43 |
| 5,120,229 | A | * | 6/1992 | Moore et al. ..... 434/263 |
| 5,131,849 | A | | 7/1992 | Perrero |
| 5,174,467 | A | * | 12/1992 | Sullivan ..... 220/571 |
| 5,176,522 | A | * | 1/1993 | Robertson, Jr. ..... 434/415 |

(Continued)

*Primary Examiner*—Kurt Fernstrom
(74) *Attorney, Agent, or Firm*—The Nath Law Group; Jerald L. Meyer; Derek Richmond

(57) ABSTRACT

A writing board support tray comprises a support tray having an end portion coated with an elastomeric material with the support tray and the elastomeric material being substantially inseparably bonded or attached to each other. Further, a writing board support tray comprises a support tray substantially completely coated with an elastomeric material with the support tray and the elastomeric material being substantially inseparably bonded or attached to each other. Additionally, a further preferred embodiment, a writing board support tray comprises a support tray with a front end substantially completely coated with an elastomeric material with the support tray and the elastomeric material being substantially inseparably bonded or attached to each other. In addition, a writing board comprising a writing surface and a support tray, wherein the peripheral edge of the writing surface is encapsulated by an elastomeric material and the support tray is constructed completely out of the elastomeric material.

11 Claims, 11 Drawing Sheets

U.S. PATENT DOCUMENTS 5,220,763 A 6/1993 Armitage
5,397,091 A * 3/1995 Tsuar ..... 248/441.1
5,501,603 A 3/1996 Mueller et al.
5,727,952 A * 3/1998 Schenck et al. ..... 434/408
6,139,331 A 10/2000 Owen
D435,593 S * 12/2000 Hellwig et al. ..... D19/52
6,241,528 B1 6/2001 Myers
6,312,628 B1 * 11/2001 Wieder et al. ..... 264/37.27
D462,992 S 9/2002 Beno
D463,493 S 9/2002 Beno
D475,407 S 6/2003 Beno
6,592,471 B1 * 7/2003 Watanabe et al. ..... 473/377
6,647,652 B1 11/2003 Seiber et al.
7,071,251 B2 * 7/2006 Thielen et al. ..... 524/47

* cited by examiner

ENCAPSULATED TRAY AND END CAPS FOR A WRITING BOARD

This application claims the benefit of Provisional U.S. Patent Application 60/509,043 filed Jun. 24, 2003 and 60/575,001 filed May 28, 2004. Both provisional applications disclosures are incorporated herein by reference in their entirety.

FIELD OF THE INVENTION

The present invention relates to writing and display devices of improved construction and safety. More particularly, the present invention relates to writing and display devices with a fully or partially encapsulated support tray and/or encapsulated tray ends.

BACKGROUND OF THE INVENTION

Devices such as chalkboards and dry erase boards are used in various situations to write and display information. These devices include a writing surface, such as slate, polymeric, or porcelain surface, which is framed by wood, metal, or a polymer in order to strengthen and protect the writing surface. In many instances, chalkboards have been replaced by dry erase boards upon which felt tip and, in particular, dry markers can be used. These boards have writing surfaces specifically designed for use with such markers. Dry markers are filled with an erasable ink, making writing or other indicia placed on the boards easily erasable. Dry marker boards have several advantages over chalkboards including reduced weight and the elimination of chalk dust.

Various dry marker boards have been developed having a multi-component, rigid frame encompassing a planar marking surface and tray. The typical frame for these devices include: an elongated top piece and a bottom piece; side pieces; a hard, rigid tray; and hard corner joining elements.

While the above devices are suitable in some instances, a dry erase marker board or other writing board having a multi-component frame with a hard, rigid tray and hard corner joining elements is not suitable for all applications. Generally, multi-component frames with the features mentioned above, have weak points at the joints of their components. Further, these devices pose a hazard if an individual accidentally bumps into or hits an edge or the tray. In addition, the joining of the components can make manufacturing these types of writing boards difficult and expensive.

Further, the above devices which have a multi-component frame, generally include hard, rigid end caps or side edges, to join and support the hard, rigid support tray for markers and erasers to the dry erase marker board. These hard, rigid end caps or side edges and support trays can be particularly hazardous and injurious to users or others that may happen to bump into or hit these particular features. In particular, users of the above devices may sustain bruises, cuts, or lacerations if they accidentally hit or bump into the end caps, edges, or support tray of the previously described devices.

Other devices utilize a unitary frame formed around a peripheral edge of the writing surface. Such devices can utilize polymers as an encapsulating edge around the writing surface. Further, these devices which have a unitary frame can have a shelf support which is mounted on the bottom portion of the writing surface by fasteners such as nails or screws. For the unitary frame to be formed for these devices, an edge molding of polyurethane is applied to the peripheral edges of the writing surface and the peripheral edges of the shelf support.

However, the above devices, both multi-component and unitary frames, as stated previously, consist of a hard, rigid support tray for markers or chalk and erasers. These support trays can be as dangerous and injurious as the end caps or edges of multi-component frames as described above. Since the support trays of the previously described devices usually jut out of the board to which they are attached, they can pose a particular hazard to the inattentive or distracted user, or child. Further, the above devices require assembly of the frame or assembly of the support tray to the frame. This assembly time increases manufacturing and/or installation costs, which in turn can increase product costs to consumers.

Of even a higher concern is for younger children that may become injured by accidentally hitting or bumping into the end caps or edges or support trays of the previous devices. As most know, children are more prone to accidents due to their developing motor skills and lack of appreciation of hazards. As such, it is desirable to remove or mitigate any sources or devices that may possibly be dangerous or injurious if a child were to accidentally run or bump into.

Despite attempts to create improved writing boards, there is a need for a safer writing board that includes a writing surface and a frame, which provides adequate strength and protection for the writing surface, and which has encapsulated end caps and/or an encapsulated tray to prevent accidental injury. Further, there is a need for such an improved writing board which is easily and economically manufactured.

SUMMARY OF THE INVENTION

There is therefore a need for a support tray and/or edge caps for a writing board that can reduce the risk or severity of injury if a person hits or bumps into the tray, and that can be easily manufactured and reduces the need for assembly.

In order to over come the above deficiencies, the current invention remedies these and other problems by combining a writing board with a support tray having encapsulated edge caps and optionally with a fully or partially encapsulated support tray. The current invention further remedies the problem of excess assembly steps and costs, or the piecing together of components by improved processes of manufacturing.

In a preferred embodiment, a writing board support tray comprises a support tray having an end portion coated with an elastomeric material with the support tray and the elastomeric material being substantially inseparably bonded or attached to each other.

In a further preferred embodiment, a writing board support tray comprises a support tray substantially completely coated with an elastomeric material with the support tray and the elastomeric material being substantially inseparably bonded or attached to each other.

In a further preferred embodiment, a writing board support tray comprises a support tray with a front end substantially completely coated with an elastomeric material with the support tray and the elastomeric material being substantially inseparably bonded or attached to each other.

In a further preferred embodiment, a writing board comprising a writing surface and a support tray, wherein the peripheral edge of the writing surface is encapsulated by an elastomeric material and the support tray is constructed completely out of the elastomeric material.

A method of manufacturing a writing board support tray comprises introducing an elastomeric material into a mold, placing a portion of the support tray into the mold, and bonding or attaching the elastomeric material the support tray.

Alternatively, a portion of the support tray can be placed into the mold with the elastomeric material added thereafter.

Additionally, a method of manufacturing a support tray comprising introducing an elastomeric material into a mold to substantially completely form the support tray.

A method of manufacturing a support tray with an elastomeric end cap comprising introducing an elastomeric material into a mold, removing the elastomeric end cap from the mold, and bonding or attaching the elastomeric end cap to the support tray.

In a further preferred embodiment, the writing board support tray further comprises a writing board. In an additional preferred embodiment, the writing board does not have an encapsulating elastomeric material surrounding the writing board.

In a further preferred embodiment, the writing board comprises a smooth front surface for writing suitable for pens, pencils, markers, chalk, or dry-erasers.

These and other aspects and features of the invention will be better understood by those of skill in the art with reference to the following figures and description wherein like numbers represent like objects throughout the several views.

DETAILED DESCRIPTION OF THE INVENTION

The present invention relates to a fully or partially encapsulated support tray and/or molded edge caps for a writing board that can reduce the risk or severity of injury if a person hits or bumps into the edge caps or tray. The present invention further relates to a writing board with a support tray constructed completely from an elastomeric material.

Figure 1:
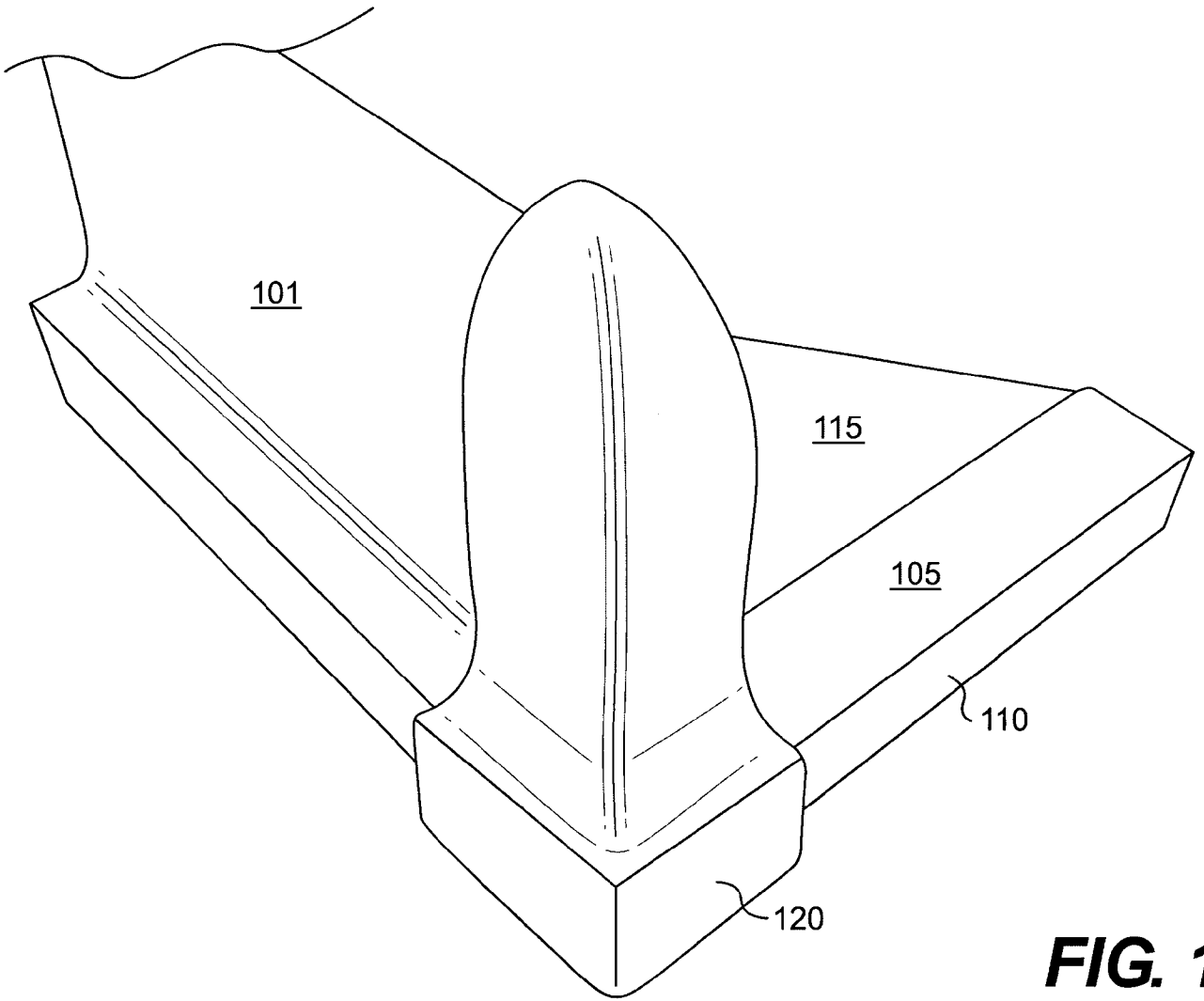
FIG. 1 is an offset perspective view of a preferred embodiment of an encapsulated end portion of a support tray for a writing board.

As shown in FIG. 1, end portion of support tray 101, along with front edge 105 and side edge 110 of writing surface 115 can be partially encapsulated to form an elastomeric end cap 120. In this preferred embodiment, the entire support tray does not need to be encapsulated by an elastomeric material; only the end portions of the support tray 115 are encapsulated along with the front edge 105 and side edge 110 of the writing surface 115 being partially encapsulated. It should be noted that only one end portion is depicted as being encapsulated, however it is understood that one or both end portions of a support tray can be encapsulated with an elastomeric material in this, and in any of the following applicable figures and descriptions.

Figure 2:
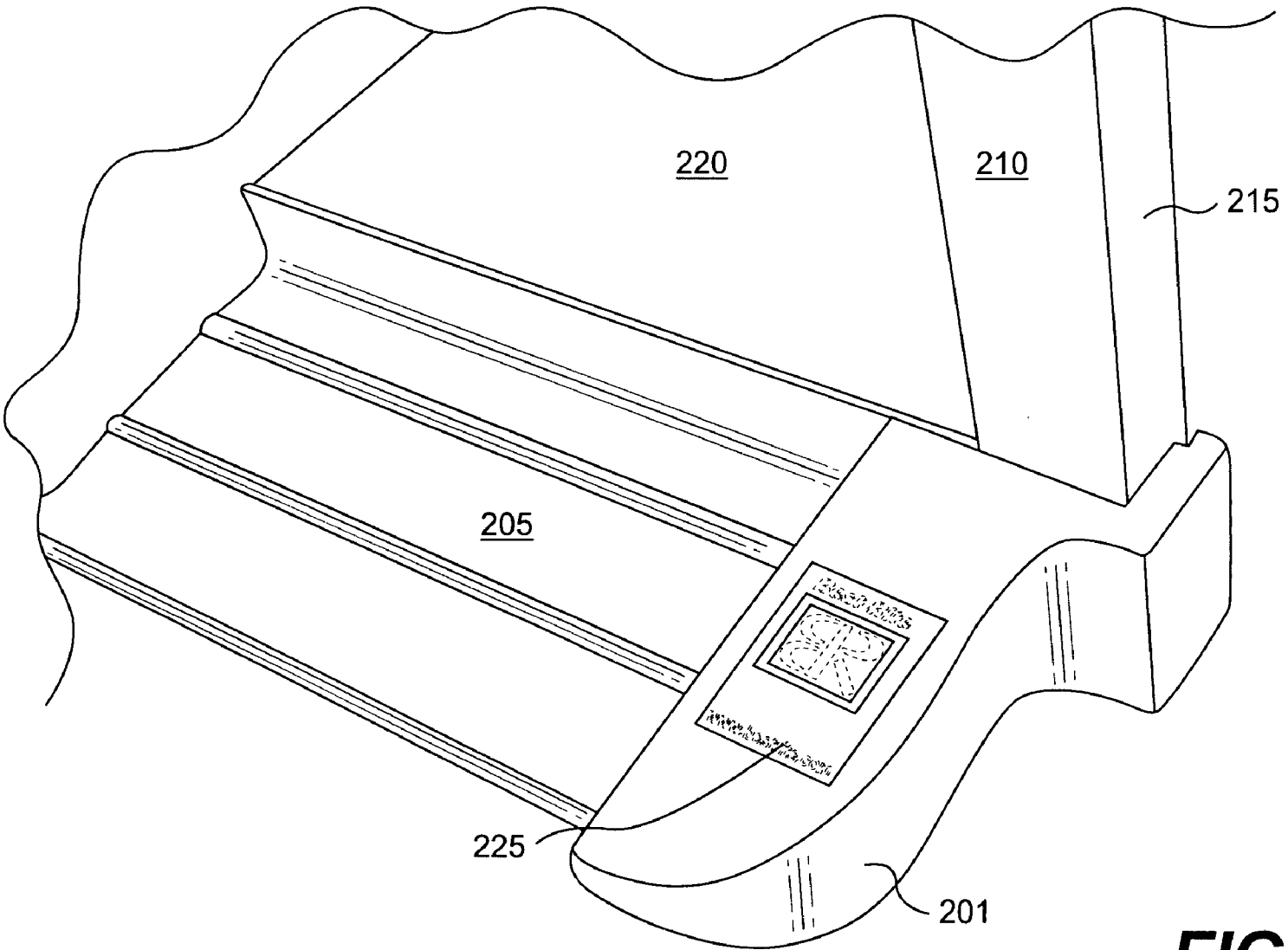
FIG. 2 is an elevational view of a preferred embodiment of an encapsulated end portion of a support tray for a writing board.

In FIG. 2, another preferred embodiment of an elastomeric end cap 201 encapsulating the end portions of support tray 205, along with a portion of front edge 210, and side edge 215 of a writing surface 220 is shown. Also, as shown by this figure, an inlay insignia 225 can be embedded in the elastomeric end cap 201.

Figure 3A:
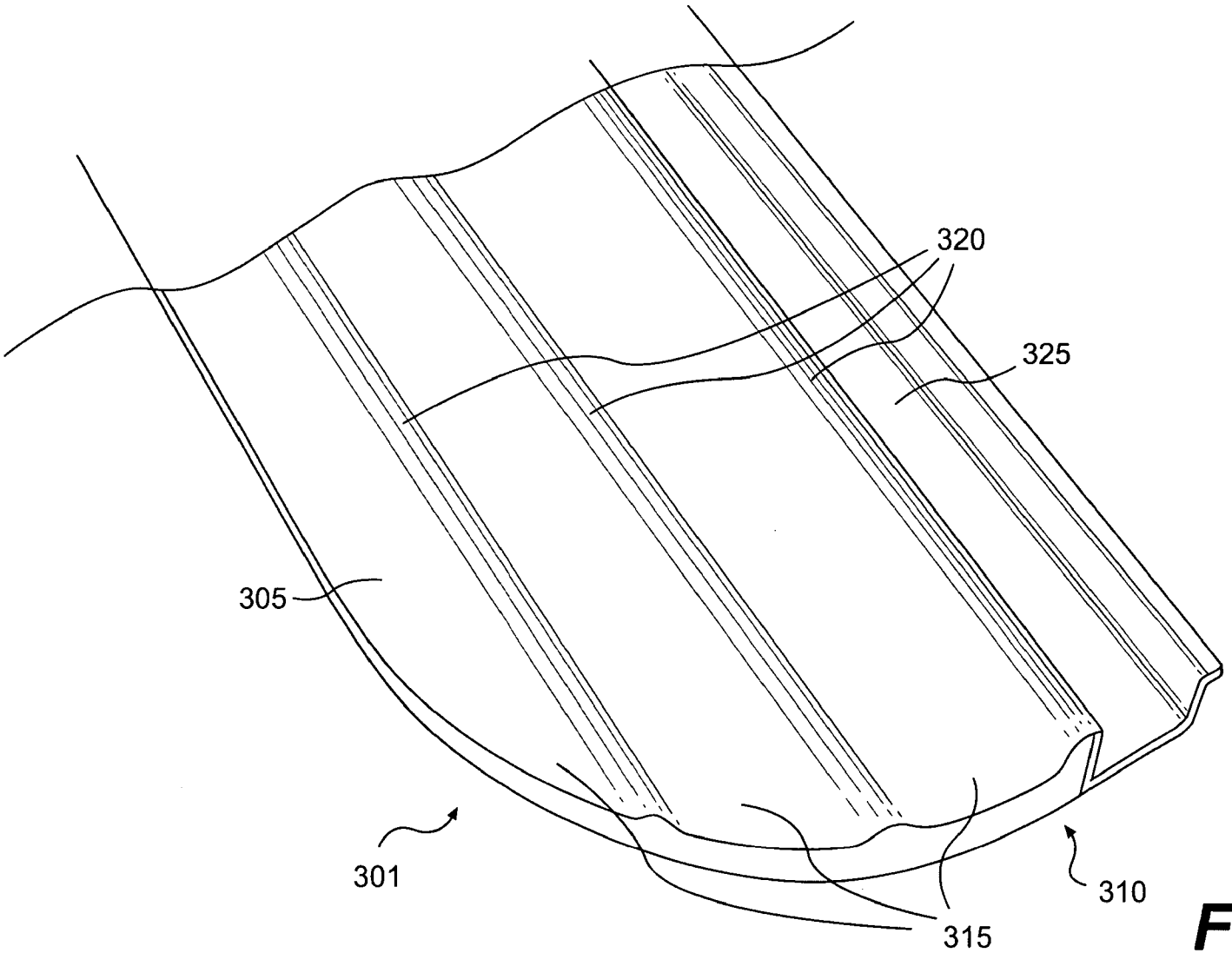
FIG. 3*a* is a top perspective view of a preferred embodiment of an encapsulated support tray for a writing board.
Figure 3B:
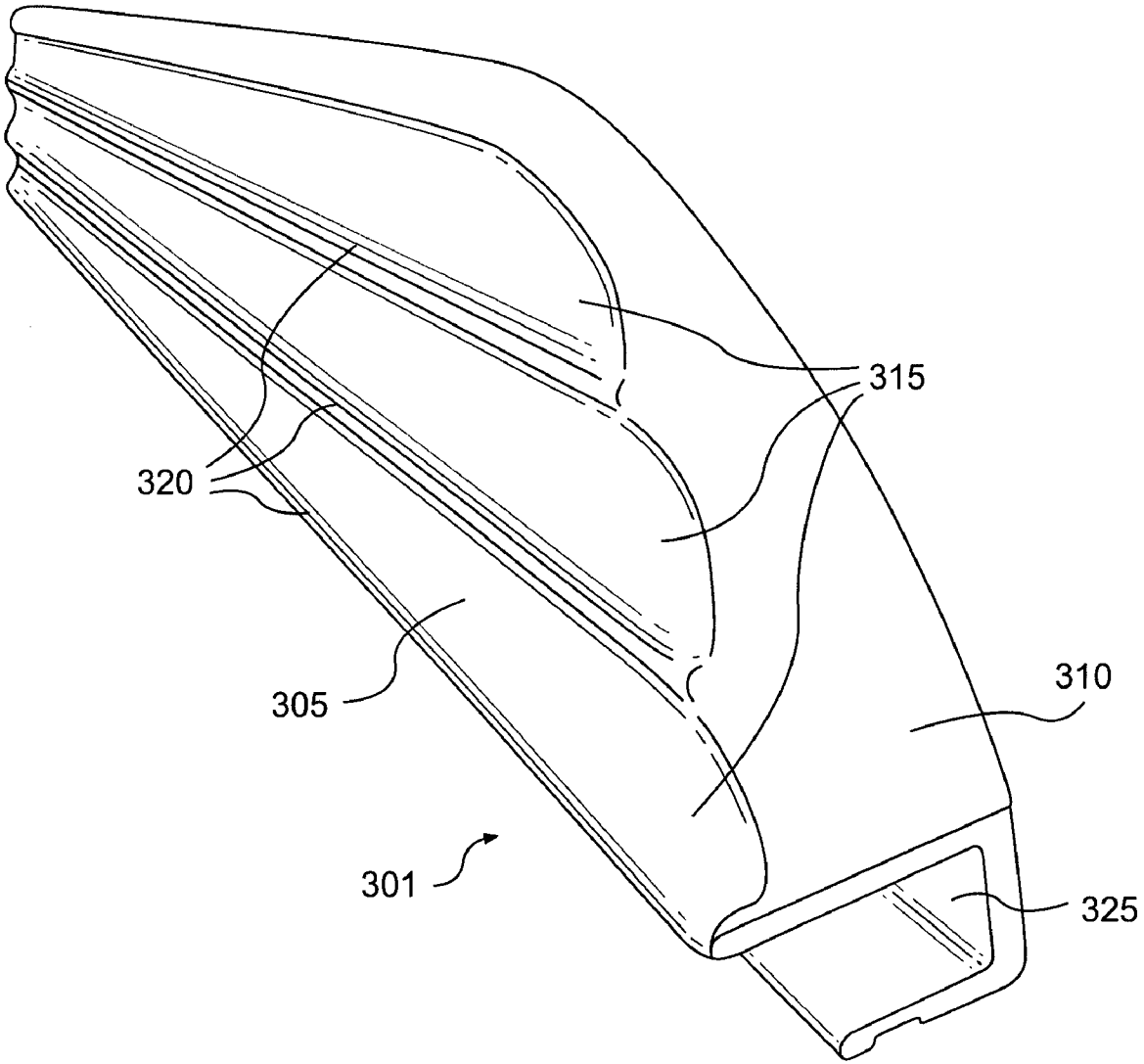
FIG. 3*b* is a side perspective view of the encapsulated support tray shown in 3*a*.

As shown in FIGS. 3*a* and 3*b*, a preferred embodiment of an encapsulated support tray 301 can be manufactured separately from, and then attached to a writing surface. The support tray 301 comprises a top 305, bottom (not shown) and two end portions 310 (only one end portion is visible in this figure), which are all encapsulated by an elastomeric material. The surface of top portion 305 of support tray 301 contains a plurality of longitudinal grooves 315 separated from each other by a plurality of corresponding longitudinal ridges 320. Also shown is a C-shaped channel 325 for attaching the encapsulated support tray 301 to a writing surface.

Figure 4:
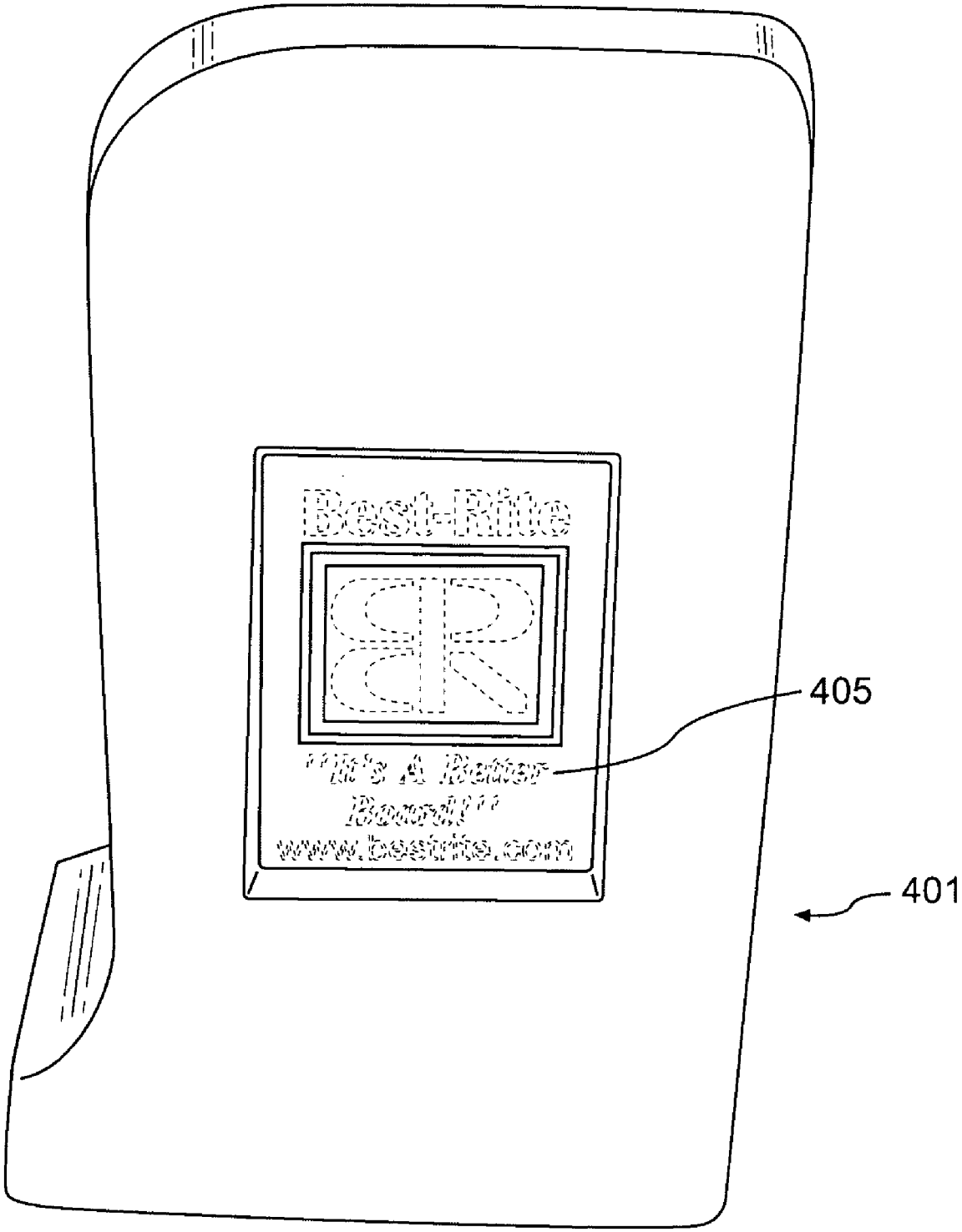
FIG. 4 is a top view of a preferred embodiment of an encapsulated edge cap for a support tray.
Figure 5:
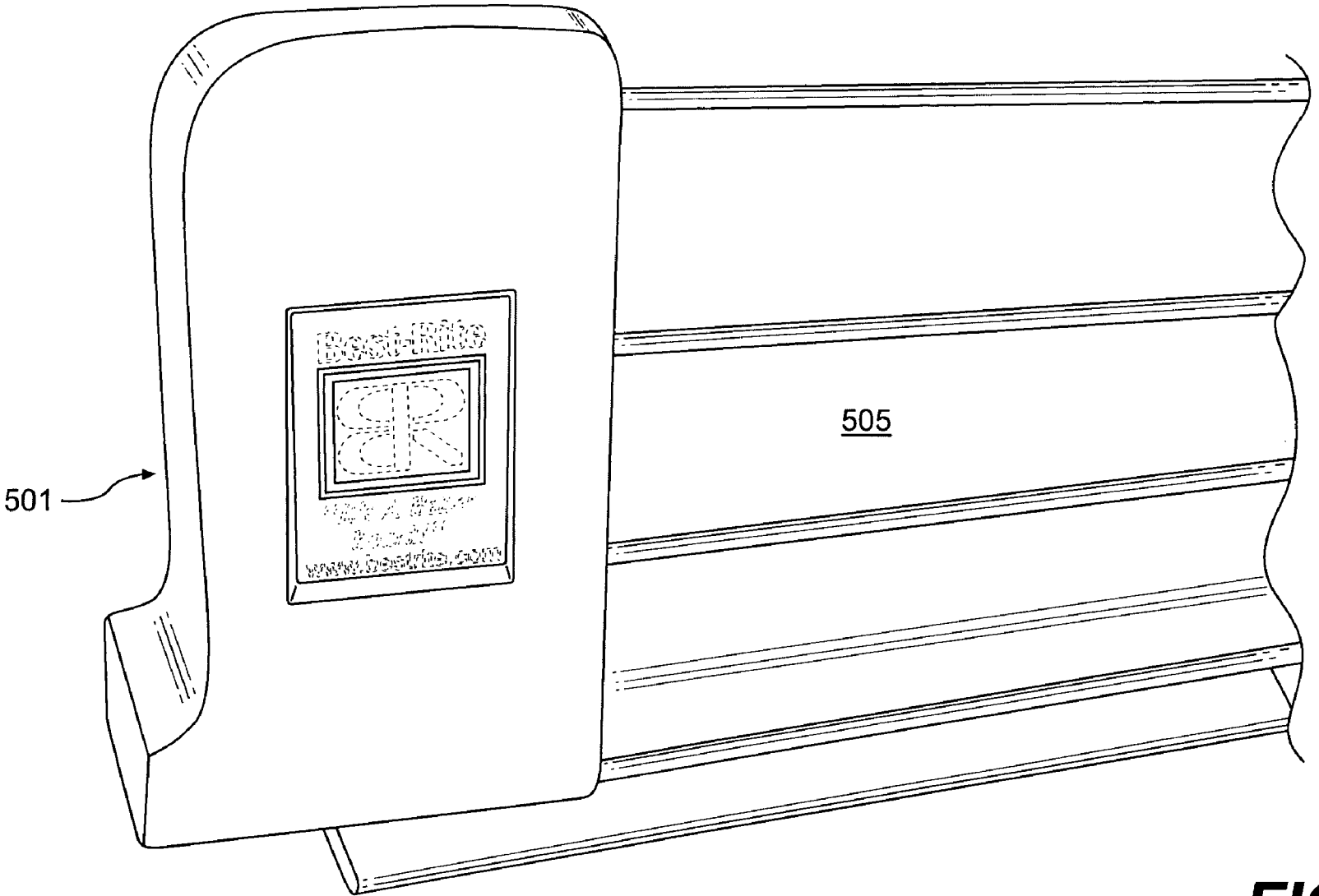
FIG. 5 is a top view of the preferred embodiment of the encapsulated edge cap of FIG. 4 on an end portion of a support tray.

Referring to FIG. 4, a preferred embodiment of an elastomeric end cap 401 can be molded separately from a support tray (as previously shown in FIGS. 1-3). End cap 401 can be attached to the support tray by bonding or an adhesive (as shown in FIG. 5). An inlay insignia 405 can be embedded in the elastomeric end cap 401.

As shown in FIG. 5 an elastomeric end cap 501 encapsulates an end portion of a support tray 505. Elastomeric end cap 501 can be molded directly onto the support tray 505, or the elastomeric end cap 501 can be molded separately from the support tray 505, and then attached to the support tray 505 by bonding or an adhesive.

Figure 6:
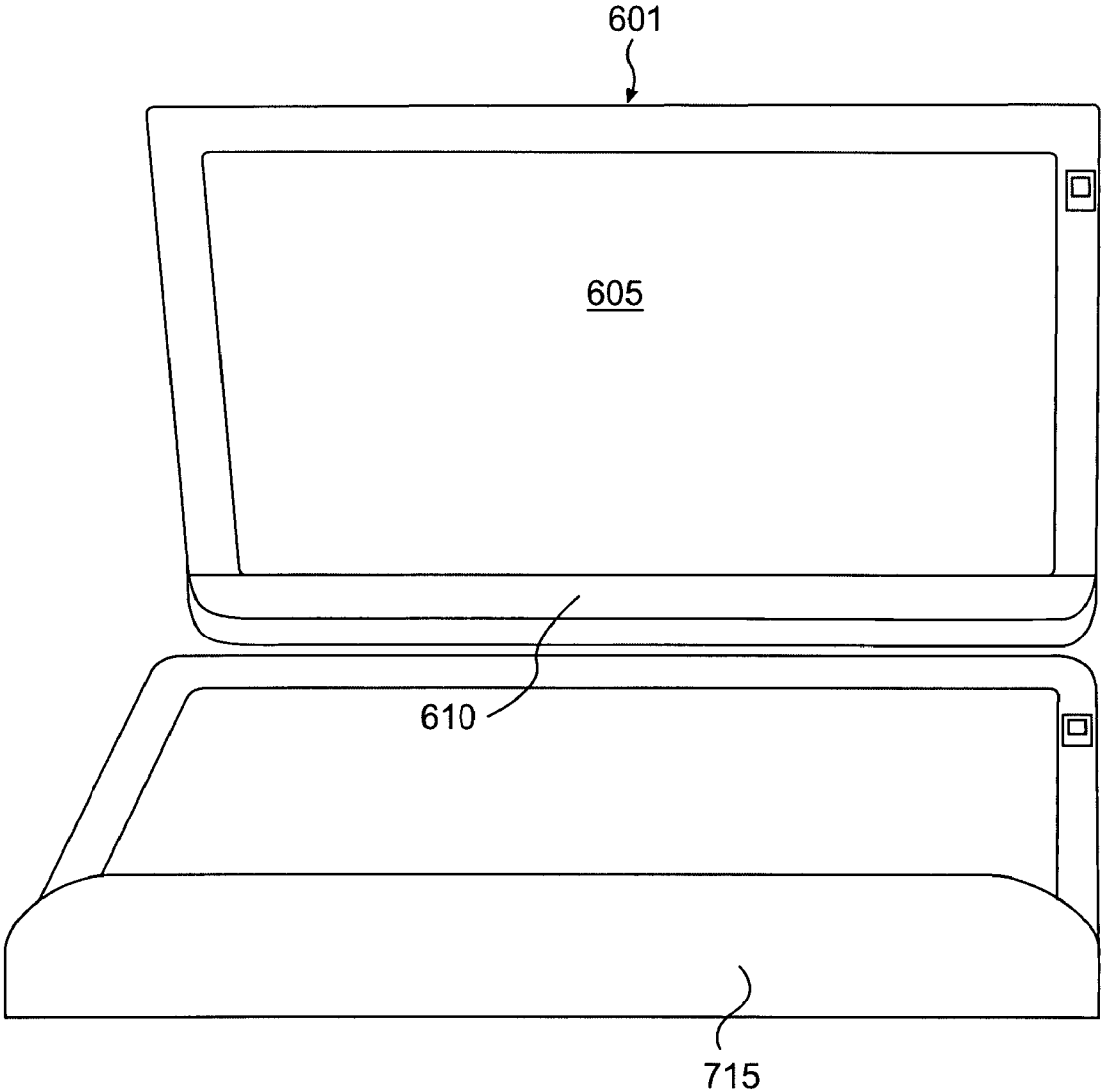
FIG. 6 is a perspective view of several preferred embodiments of an encapsulated support tray for a writing board.

As shown in FIG. 6, an entire peripheral edge 601 of a writing surface 605 can be encapsulated by an elastomeric material, with a support tray 610 being fully encapsulated with the elastomeric material.

Figure 7:
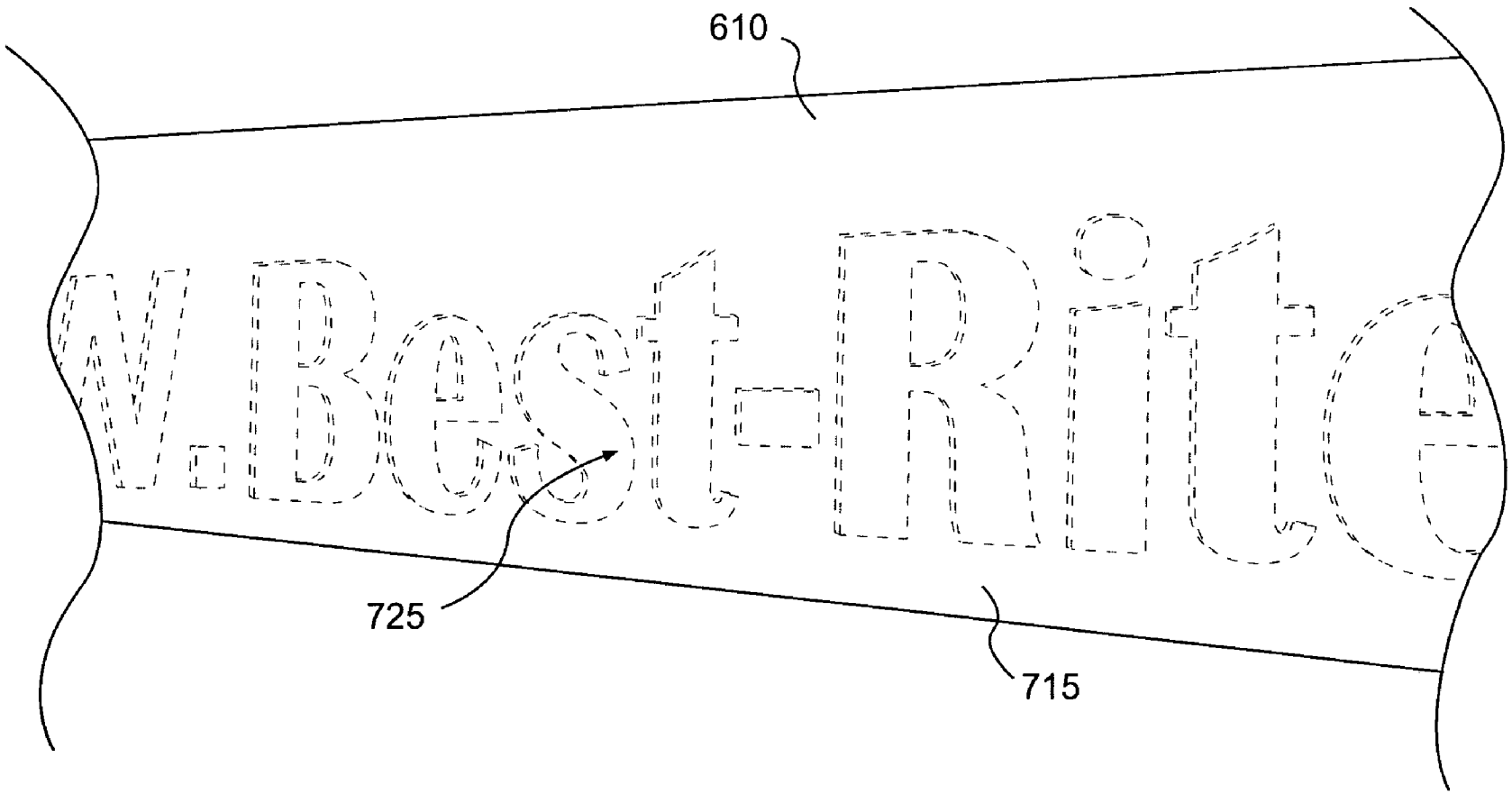
FIG. 7 is a partial, bottom view of a bottom portion of a preferred embodiment of an encapsulated support tray for a writing board.

As shown in FIG. 7, a bottom portion 715 of a support tray 610 fully encapsulated with an elastomeric material can be molded to include various indicia, such as indicia 725 in the surface of the elastomeric material.

Figure 8:
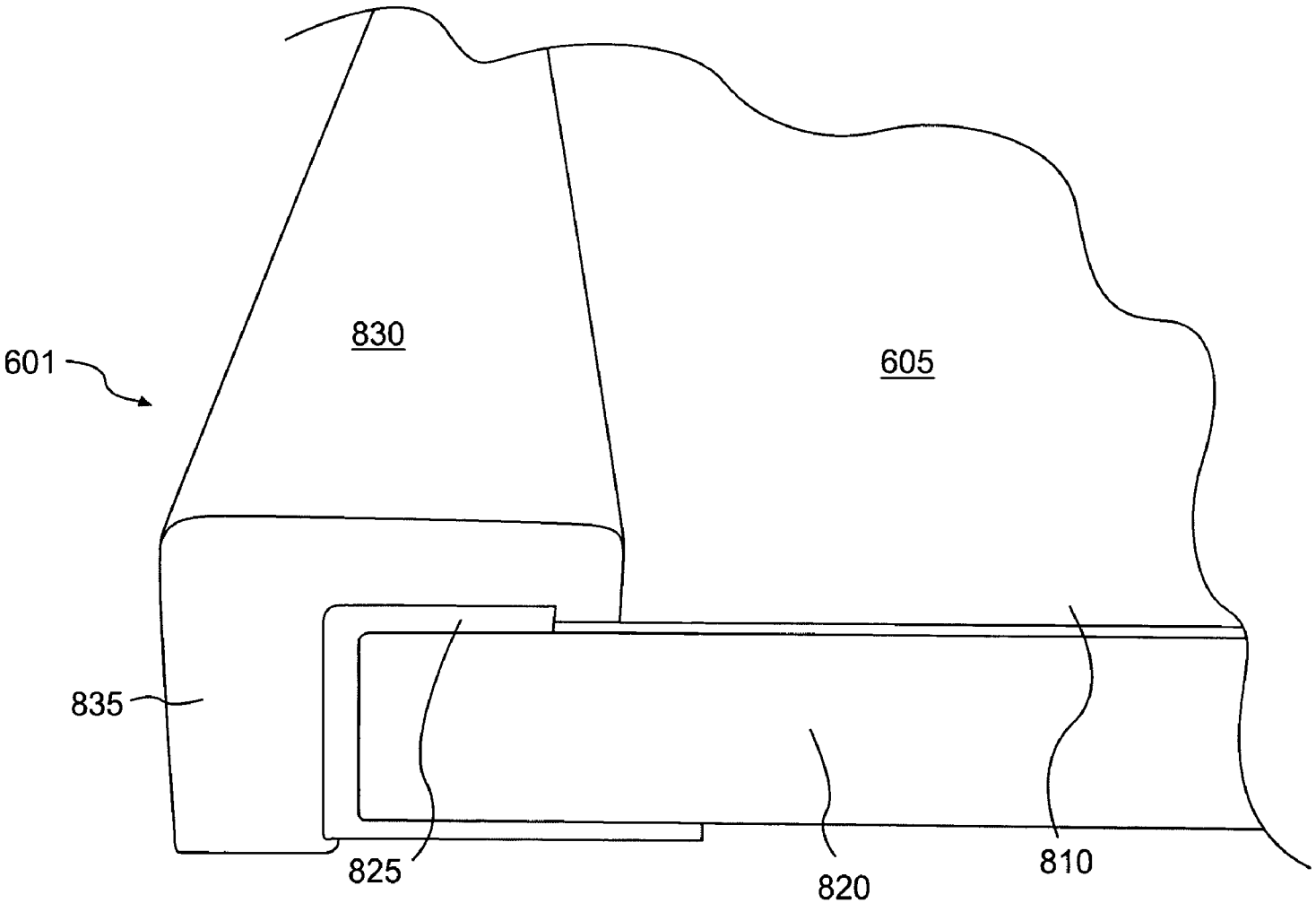
FIG. 8 is a sectional view of a preferred embodiment of an encapsulated writing board.

As shown in FIG. 8, the writing surface 605 comprises a front surface 810 of a dry-erasable surface material connected to support surface 820 and edge support surface 825. Writing surface 605 is partially encapsulated along its front 830 and side 835 edges, which collectively form the peripheral edge 601.

Figure 9A:
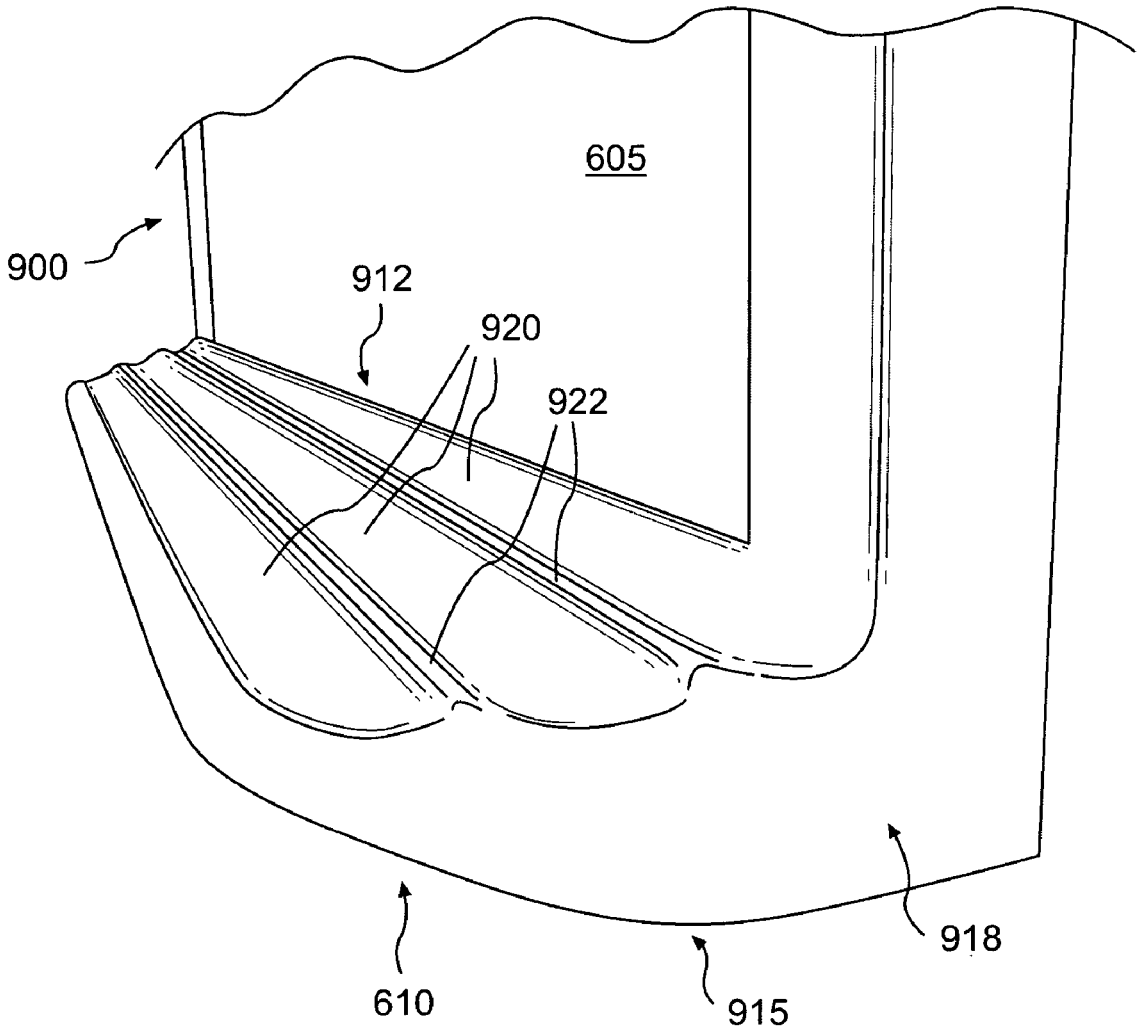
FIG. 9*a* is a side view of a preferred embodiment of an encapsulated support tray.
Figure 9B:
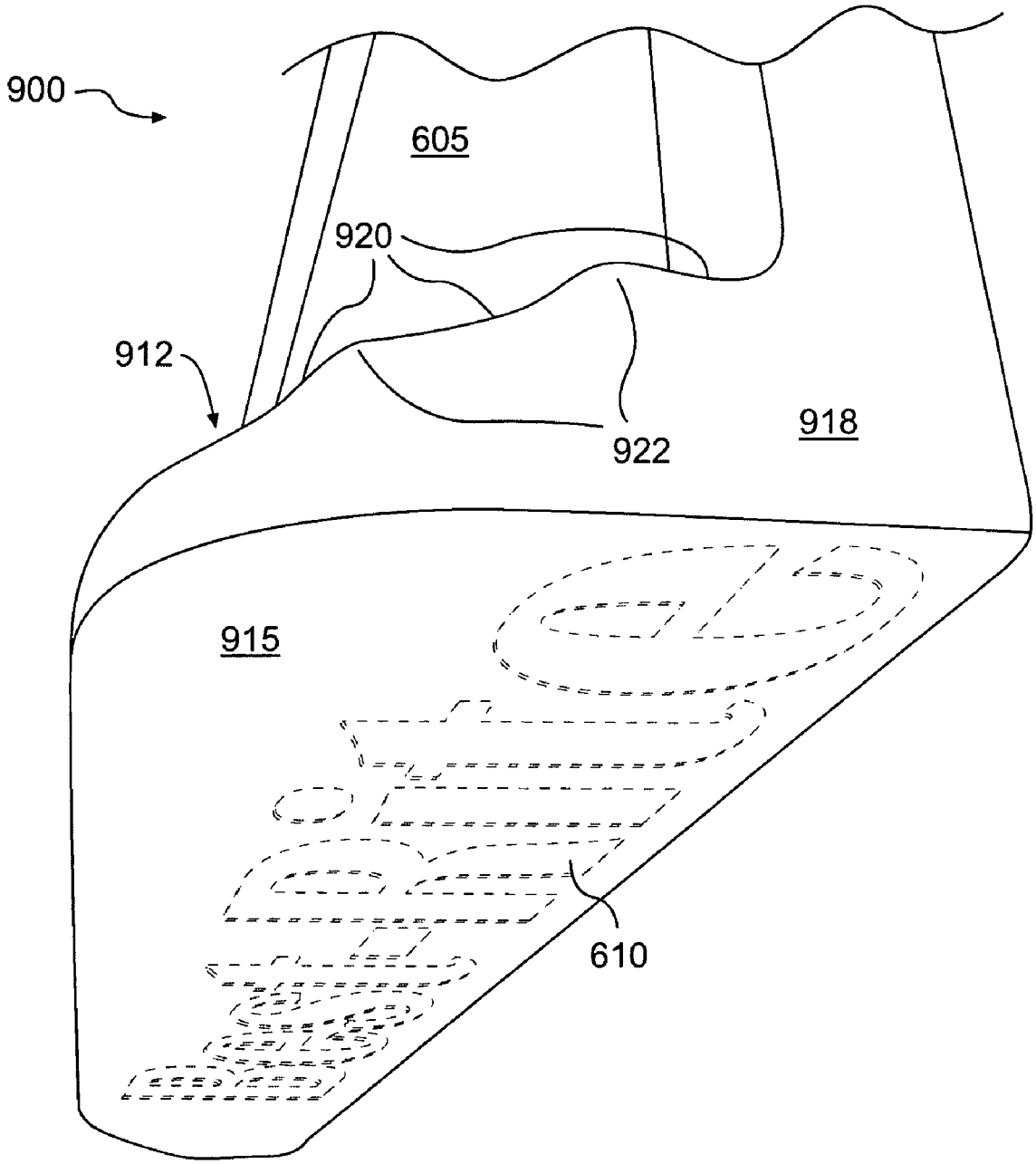
FIG. 9*b* is an offset side view of a preferred embodiment of an encapsulated support tray.

In a preferred embodiment of a writing board 900 shown in FIGS. 9*a* and 9*b*, the writing surface 605 and the support tray 610 are encapsulated with an elastomeric material. The support tray 610 comprises a top 912, bottom 915 and two end portions 918 (only one end portion is visible in this figure), which are all encapsulated with the elastomeric material. The surface of top portion 912 of support tray 610 contains a plurality of longitudinal grooves 920 separated from each other by corresponding longitudinal ridges 922.

It is understood that the above descriptions are not, and should not be, limited solely to that explicitly shown in the figures. The end portions of the support tray can be encapsulated by the same elastomeric material as that used to encapsulate the writing surface, or can be a different elastomeric material. Further, as shown in the figures and described above, the support tray can be substantially or entirely encapsulated with an elastomeric material. Additionally, the support tray can be substantially or fully constructed from an elastomeric material.

Above, in FIGS. 1–9*b*, only exemplary showings of some of the preferred embodiments of the present invention are described in detail. Other alternative embodiments are also desired. For example, in one alternate embodiment, the end portions and the rest of the support tray can be partially or fully encapsulated with different elastomeric materials. Further, the elastomeric material used to encapsulate the writing surface of a writing board can be the same or different than that used to encapsulate the support tray in part or in full. Additionally, the top portion of support tray need not be encapsulated with an elastomeric material.

The support tray can be flat or curved and can have one or more grooves, holes, channels, or similar features. In a preferred embodiment, an edge of the support tray distal from the channel 315 can be thinner than an opposite edge proximal the channel 315. However, in an alternate embodiment the edge of the support tray distal from the channel 315 can be the same thickness than an opposite edge proximal the channel 315.

In a preferred embodiment, the support tray can be constructed from any suitable material or material including, but not limited to, metal(s), alloy(s), wood(s), porcelain, polymer(s), elastomer(s), or combinations thereof. In a more preferred embodiment, the support tray is constructed out of aluminum, an aluminum alloy material, anodized aluminum, a plastic, an elastomer, or similar material. In the most preferred embodiment, the support tray is constructed out of aluminum, an aluminum alloy material, anodized aluminum, or an elastomer.

In a further preferred embodiment, the support tray can be completly formed from an elastomeric material. Further, the support tray, except for the C-shaped channel can be completely formed from an elastomeric material. Additionally, the support tray can be completely formed from an elastomeric material, including the C-shaped channel or corresponding other structure(s) used to attach the support tray to the writing surface.

The encapsulated support tray can be constructed such that only the support tray is encapsulated, in part or in full, or constructed such that when connected to a writing surface, portions of the encapsulated support tray lie over or cover portions of the peripheral edge of the writing surface.

The support tray can be connected to the writing surface such that it forms a unitary encapsulated structure (as shown in FIG. 6), or the support tray can be connected to the writing surface in separate pieces by any acceptable means or process, including but not limited to, screws, crimps, clasps, nails, bolts, other joinery means and techniques known in the art, adhesives, bonding agents, encapsulation, or combinations thereof.

The support tray can have any suitable structure for attaching purposes to a writing surface including, but not limited to, a C-shaped channel (as shown in FIGS. 3*a* and 3*b*), an L-, U-, or Z-shaped channel, a blunt edge, a lip, or a tongue. Further, the attaching structure of the support tray can be of any desirable shape or size for use in attaching the support tray to the writing surface.

The writing surface for the writing board can be formed from a single material or various materials, and combined by any applicable means such that the front surface of the writing surface can be written upon and erased. The writing surface can be constructed from, but not limited to, wood, metal, alloy(s), polymer(s), porcelain, elastomer(s), or combinations thereof. Further, the top, bottom, and/or sides of the peripheral edge of the writing surface need not be encapsulated.

The writing board can contain indicia on the writing surface, encapsulated peripheral edge of the writing surface, support tray, and on the end caps. Such indicia can be formed within the molding process, or can be connected to the writing board after the molding process. Such indicia include, but are not limited to, words, letters, shapes, designs, or combinations thereof.

Further, an edge cap can be molded in a similar fashion as that of a support tray, which is described below. To obtain just an elastomeric end cap for attaching to a support tray, the support tray is not introduced into a mold, and after a hardening time, the edge cap is removed and then connected to the support tray by any suitable process including, but not limited to, screws, crimps, clasps, nails, bolts, adhesives, bonding agents, encapsulation, or combinations thereof.

The edge cap can be constructed to cover just the end portions of the support tray, or constructed to cover the end portions of the support tray and portions of the peripheral edge of the writing surface. Further, the edge cap can be constructed to cover further portions of the support tray in addition to the end portions.

A support tray can have the end portions of the support tray encapsulated by a molding process, which is described below. The encapsulated end portions on either end of a support tray can be of any desirable shape or size, and can be attached to one another by (a) strip(s) or (a) segment(s) running along the length of the support tray.

To prepare a preferred embodiment of an elastomeric encapsulation end cap or a support tray with the end portions encapsulated in elastomeric material, a mold is prepared. The mold is prepared by conventional means, and is well known in the art. The current process utilized is such that a reverse-negative mold is produced from a pattern. The pattern is a solid form of the desired end product, which is then set in a setting material to form a reverse-negative mold. Ideally the setting material is a silicon containing material, or plaster. The mold is then used to cast a final product as described below.

After the mold has been prepared, end portions of a support tray are introduced into the mold. An elastomeric material is then introduced into the mold in semi-solid or liquid forms. After a hardening time elapses, the support tray is removed from the mold with the end portions of the support tray being encapsulated in the elastomeric material. The molding process can include encapsulating only one end portion of a support tray at a time, or encapsulating both end portions of a support tray at a time. If only an elastomeric end cap is desired, then a mold modified to form a pocket in the elastomer is used such that the tray is not introduced into the mold. After a hardening time elapses, the elastomeric end cap is removed from the mold. The interior of the pocket is configured to conform to an outer surface of the support tray and receives the tray therein.

To prepare a preferred embodiment of an encapsulated writing surface with a support tray encapsulated with an elastomeric material, or completely constructed from an elastomeric material, a mold is filled with an elastomeric material in semi-solid or liquid form. A pre-assembled, or non-pre-assembled writing board is then placed in whole, or in parts, into the mold to encapsulate the desired areas of the writing board. If the writing board includes a support tray to be encapsulated then the support tray is introduced into the mold, and if the writing board is to have a support tray constructed completely from an elastomeric material, then no such support tray is not introduced into the mold. Alternatively, the writing board can be placed in the mold first, followed by introduction of the elastomeric material. After a hardening time elapses, the encapsulated writing board can be removed from the mold preferably as a whole, but this can also be accomplished in parts. If not already completely assembled, the writing board can then be assembled.

The mold can be constructed from any suitable materials including, but not limited to, wood(s), metal(s), alloy(s), fiberglass, polymer(s), porcelain, elastomer(s), cement, plaster, or combinations thereof. Ideally, the mold is constructed from a plaster based or a silicon containing material, such as plaster paris (gesso) or silicone.

The molding process can include the process to form a desired indicia, such as a logo, name, web-address, etc., on an encapsulated portion of the writing board, including that of the tray. Such a process includes modifying the mold to form the desired indicia on the final product cast within the mold.

Further, the encapsulation process can be automated. For example, the mold can completely surround the writing surface and/or support tray, and the elastomeric material can be injected into the mold. As a further example, the mold can be an inlay mold with the elastomeric material injected into the mold after the writing surface and/or support tray has/have been placed in the mold to form a writing board, or part thereof. As a further alternative, the encapsulating elastomeric material can be sprayed onto any desired areas of the writing surface and/or tray which are to be encapsulated.

The basic properties of a preferred elastomeric material used for the preferred embodiments of the present invention are such that the elastomeric material is durable enough to withstand stress, yet soft enough to prevent serious injury if accidentally bumped into. The encapsulated portion of the writing board can also be used for a tack strip, and other similar uses.

Ideally, the preferred elastomeric material will be a silicon containing, a vinyl acetate containing, a polyurethane containing, or a thermal polyurethane containing material, or combinations thereof. Most preferably, the elastomeric material will be a silicon containing material, such as silicone, for its non-combustible, non-foaming, ultra-violet, and colorfast properties. Typically, any elastomeric material can be used which falls between a shore A hardness of 45–100. Preferably, the elastomeric material will have a shore A hardness of 55–90, and most preferably the elastomeric material will have a shore A hardness of 70–75. The shore A hardness of an elastomer can be measured on a shore A durometer amongst other devices and mechanisms.

As previously described, the preferred embodiment of the elastomeric material and/or elastomeric end caps can be molded directly onto the surface of a writing surface or support tray such that the elastomeric material and writing surface or support tray form an indestructible bond and are inseparable under normal stress conditions. Alternatively, the elastomeric material and/or elastomeric end caps can be molded separately and then affixed around the surface of a writing surface or support tray by use of an adhesive, bonding agent, or connecting means.

In the most preferred embodiment, the elastomeric material is silicone, or a silicon containing elastomer, and is molded directly to an aluminum surface either on the writing surface, support tray, or both. Further, in the most preferred embodiment, the silicon containing elastomeric material is molded directly to an aluminum surface by utilizing a primer to etch and prime the surface of the aluminum to aid in the bond between the silicon containing elastomeric material and the aluminum.

Tinting, pigments, or coloring agents can be added to the elastomeric material for color effects. Preferred amounts of tinting, pigments, or coloring agents range between 0.01–15% in a weight-to-weight ratio between the total weight of the tinting, pigment, or coloring agents, and the total weight of the elastomeric material used. More preferably, the amounts of tinting, pigments, or coloring agents range between 1–10% in a weight- to-weight ratio between the total weight of the tinting, pigment, or coloring agents, and the total weight of the elastomeric material used. Most preferably, the amounts of tinting, pigments, or coloring agents range between 3–6% in a weight-to-weight ratio between the total weight of the tinting, pigment, or coloring agents, and the total weight of the elastomeric material used.

Below is an exemplary method of manufacturing an elastomeric encapsulated writing board.

EXAMPLE 1

Prepare a mold with an inner shell of 12"×22";

Prepare or obtain a writing surface with trim weights 2,204 grams with a 10 15/16"×20 7/8"×½" porcelain coated surface, with ½"×⅞"×½" aluminum trim on three sides;

Use aluminum tray cut to 19⅛" long on bottom edge of writing surface;

Writing surface with aluminum attached is 11"×21";

Brush coat aluminum trim with X-5665 primer from GT Products, Inc. and wait till aluminum/primer turns powdery white;

Spray coat mold and inner shell with Ease Release 200 mold release from GT Products, Inc.;

Pour 1,093 grams of GT-5104 liquid silicone rubber from GT Products, Inc. into mixing bucket;

Mix in 50 grams (4.5% of 1,093) of blue GT-5673 color tint from GT Products, Inc.;

Check color match;

Add 109 grams (at 10:1 ratio of the org. 1,093) of clear catalyst C-5813 from GT Products, Inc., hand mix with no vacuum;

Pour mixture into mold and fill to board face line;

Insert primered writing surface into mold slowly at an angle to allow air to escape;

Edge pour the remaining silicone into mold making sure to fill to the back edge of the writing surface;

Allow silicone to harden and set (hardening time which is typically 10 minutes from point that catalyst is added);

Remove finished encapsulated writing surface from mold. A screwdriver can be used to break the mold suction between the mold and the encapsulated writing surface;

Remove Ease Release 200 mold release from board with alcohol on a rag;

Finished encapsulated writing surface weight was 3,282 grams;

Amount of silicone in encapsulated writing surface was 1,078 grams;

Clean logo recess with alcohol;

Coat logo recess with RTV silicone glue;

Press logo into recess;

The above example can be modified in many different ways to obtain the desired end product, and in no way should be seen as limiting the spirit and scope of the disclosed invention. Further, the dimensions, amounts and weights used are used for this example only, and should not be seen as limiting the spirit and scope of the disclosed invention.

For instance, in the above example X-5665 primer, Ease Release 200, and catalyst C-5813 from GT Products, Inc. of Grapevine Texas are used in the preparation and formation of an encapsulated writing surface. It is well understood that these are only some of the various constituents which can be used to arrive at the same or similar desired product by a similar process. Therefore, it will be apparent to one skilled in the art that the exact items above need not be used, only similar and related items to practice the desired process and arrive at the desire product.

If only an encapsulated support tray in desired, then from the spirit and scope of the above methodology, one can replace a writing surface with only a support tray, with the mold used being different as previously described. Further, if only portions of a support tray are to be encapsulated, then the spirit and scope of the above methodology can be modified such that the writing surface is replaced with portions of the support tray and a suitable mold as previously described. Additionally, if only elastomeric end caps or a support tray substantially constructed from an elastomeric material is desired, the mold can be adapted as such within the spirit and scope of this disclosure from the above methodology.

The present invention has been described with respect to preferred selected embodiments, and several alternative embodiments thereof. However, other embodiments would be obvious to those skilled in the art without departing from the spirit and scope of the appended claims.

What is claimed is:

1. A writing board tray comprising
an elastomeric material,
a support tray, and
a writing surface perpendicular to said support tray;
said support tray having an end portion coated with said elastomeric material, and
said support tray and said elastomeric material being substantially inseparably bonded or attached to each others,
wherein said writing surface does not have said elastomeric material surrounding said writing surface.

2. A writing board tray of claim 1 wherein the elastomeric material is a silicon containing, polyurethane containing, or a thermoplastic containing material.

3. A writing board tray of claim 1 wherein said support tray comprises a plurality of longitudinal grooves separated from each other by at least one corresponding longitudinal ridge.

4. A writing board tray comprising
an elastomeric material,
a support tray, and
a writing surface perpendicular to said support tray;
said support tray being substantially completely coated with said elastomeric material,
said tray and said elastomeric material being substantially inseparably bonded or attached to each other;
wherein said writing surface does not have said elastomeric material surrounding said writing surface.

5. A writing board tray of claim 4 wherein the elastomeric material is a silicon containing, polyurethane containing, or a thermoplastic containing material.

6. A writing board tray of claim 4 wherein said support tray comprises a plurality of longitudinal grooves separated from each other by at least one corresponding longitudinal ridge.

7. A writing board tray comprising
an elastomeric material,
a support tray, and
a writing surface perpendicular to said support tray;
said support tray having a front edge substantially completely coated with said elastomeric material,
said tray and said elastomeric material being substantially inseparably bonded or attached to each other,
wherein said writing surface does not have an encapsulating elastomeric material surrounding said writing surface.

8. A writing board tray of claim 7 wherein the elastomeric material is a silicon containing, polyurethane containing, or a thermoplastic containing material.

9. A writing board tray of claim 7, wherein
said front edge is connected to an end portion substantially completely coated with said elastomeric material by a substantially completely coated elastomeric strip,
said tray and said elastomeric material being substantially inseparably bonded or attached to each other.

10. A writing board tray of claim 7 wherein said support tray comprises a plurality of longitudinal grooves separated from each other by at least one corresponding longitudinal ridge.

11. A writing board comprising
a writing surface and
a support tray perpendicular to said writing surface,
wherein a peripheral edge of said writing surface is encapsulated by a first elastomeric material and
said support tray is constructed completely out of a second elastomeric material.

* * * * *

UNITED STATES PATENT AND TRADEMARK OFFICE

CERTIFICATE OF CORRECTION

PATENT NO. : 7,207,805 B2
APPLICATION NO. : 10/874580
DATED : April 24, 2007
INVENTOR(S) : Moore et al.

It is certified that error appears in the above-identified patent and that said Letters Patent is hereby corrected as shown below:

Claim 1, Column 9, Line 41,
Please delete " others " and
replace with -- other --

Claim 11, Column 10, Line 44,
Please delete " perpendicular to said writing " and
replace with -- perpendicular to and extending outwardly from said writing --

Claim 11, Column 10, Line 46,
Please delete " first elastomeric " and
replace with -- first type of elastomeric --

Claim 11, Column 10, Line 48,
Please delete " second elastomeric " and
replace with -- second type of elastomeric --

Signed and Sealed this

Second Day of October, 2007

JON W. DUDAS
*Director of the United States Patent and Trademark Office*